US011677136B2

(12) United States Patent
Hamabe

(10) Patent No.: US 11,677,136 B2
(45) Date of Patent: Jun. 13, 2023

(54) ANTENNA DEVICE AND COMMUNICATION DEVICE

(71) Applicant: Panasonic Intellectual Property Management Co., Ltd., Osaka (JP)

(72) Inventor: Taichi Hamabe, Kanagawa (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 13 days.

(21) Appl. No.: 17/373,133

(22) Filed: Jul. 12, 2021

(65) Prior Publication Data

US 2022/0037762 A1 Feb. 3, 2022

(30) Foreign Application Priority Data

Jul. 31, 2020 (JP) ..... JP2020-131023

(51) Int. Cl.
*H01Q 1/22* (2006.01)
*H01Q 1/24* (2006.01)

(52) U.S. Cl.
CPC ..... *H01Q 1/2291* (2013.01); *H01Q 1/22* (2013.01); *H01Q 1/24* (2013.01)

(58) Field of Classification Search
CPC ..... H01Q 1/24; H01Q 19/108; H01Q 15/006; H01Q 1/2291; H01Q 1/22
USPC ..... 343/850
See application file for complete search history.

(56) References Cited

U.S. PATENT DOCUMENTS

2015/0263426 A1* 9/2015 Hsu ..... H01Q 15/008 703/1
2016/0020648 A1* 1/2016 Contopanagos ..... H02J 50/23 307/104
2019/0081394 A1* 3/2019 Edwards ..... H01Q 1/48
2020/0196439 A1* 6/2020 Hamabe ..... H05K 1/0253

FOREIGN PATENT DOCUMENTS

JP 2015-70542 4/2015

* cited by examiner

*Primary Examiner* — Hai V Tran
(74) *Attorney, Agent, or Firm* — Wenderoth, Lind & Ponack, L.L.P.

(57) ABSTRACT

An antenna device includes: a feeding antenna conductor; a non-feeding antenna conductor; a ground conductor; a first artificial magnetic conductor disposed between the feeding antenna conductor and the non-feeding antenna conductor, and the ground conductor; and a second artificial magnetic conductor disposed side by side with the first artificial magnetic conductor and electrically connected to the ground conductor. The feeding antenna conductor and the non-feeding antenna conductor are disposed on the first artificial magnetic conductor.

13 Claims, 13 Drawing Sheets

ANTENNA DEVICE AND COMMUNICATION DEVICE

BACKGROUND

1. Technical Field

The present disclosure relates to an antenna device and a communication device.

2. Description of the Related Art

Unexamined Japanese Patent Publication No. 2015-70542 discloses an antenna device using an artificial magnetic conductor (hereinafter referred to as an AMC).

SUMMARY

The present disclosure provides an antenna device and a communication device that achieve both widening of an operating frequency and improvement of an antenna gain even in a placement in which their periphery is covered with a metal structure.

The present disclosure provides an antenna device including: a feeding antenna conductor; a non-feeding antenna conductor; a ground conductor; a first artificial magnetic conductor disposed between the feeding antenna conductor and the non-feeding antenna conductor, and the ground conductor; and a second artificial magnetic conductor disposed side by side with the first artificial magnetic conductor and electrically connected to the ground conductor. The feeding antenna conductor and the non-feeding antenna conductor are disposed on the first artificial magnetic conductor.

The present disclosure also provides a communication device including: the antenna device described above; a display; a front panel that protects the display; and a metal frame that surrounds the antenna device and has a window opening larger in area than the antenna device. The antenna device is fixed to the front panel and surrounded by the window opening of the metal frame.

According to the present disclosure, the antenna device and the communication device can achieve both widening of an operating frequency and improvement of an antenna gain even in a placement in which their periphery is covered with a metal structure.

DETAILED DESCRIPTION

Hereinafter, exemplary embodiments specifically disclosing an antenna device and a communication device according to the present disclosure will be described in detail with reference to the drawings as appropriate. However, an unnecessarily detailed description may be eliminated. For example, detailed description of a well-known item or duplicated description of substantially identical structure may be eliminated. This is to prevent the following description from being unnecessarily redundant to facilitate understanding of those skilled in the art. The attached drawings and the following description are provided for those skilled in the art to fully understand the present disclosure, and are not intended to limit the subject matter described in the scope of claims.

In a first exemplary embodiment below, an antenna device having an operating frequency of a 2.4 GHz band (e.g., 2400 MHz to 2500 MHz) and being capable of performing wireless communication conforming to standards of a wireless local area network (LAN) such as Bluetooth (registered trademark) and Wi-Fi (registered trademark) will be described as an example. However, the antenna device according to the first exemplary embodiment may perform wireless communication in a frequency band conforming to a standard other than the above-described standards.

Figure 1:
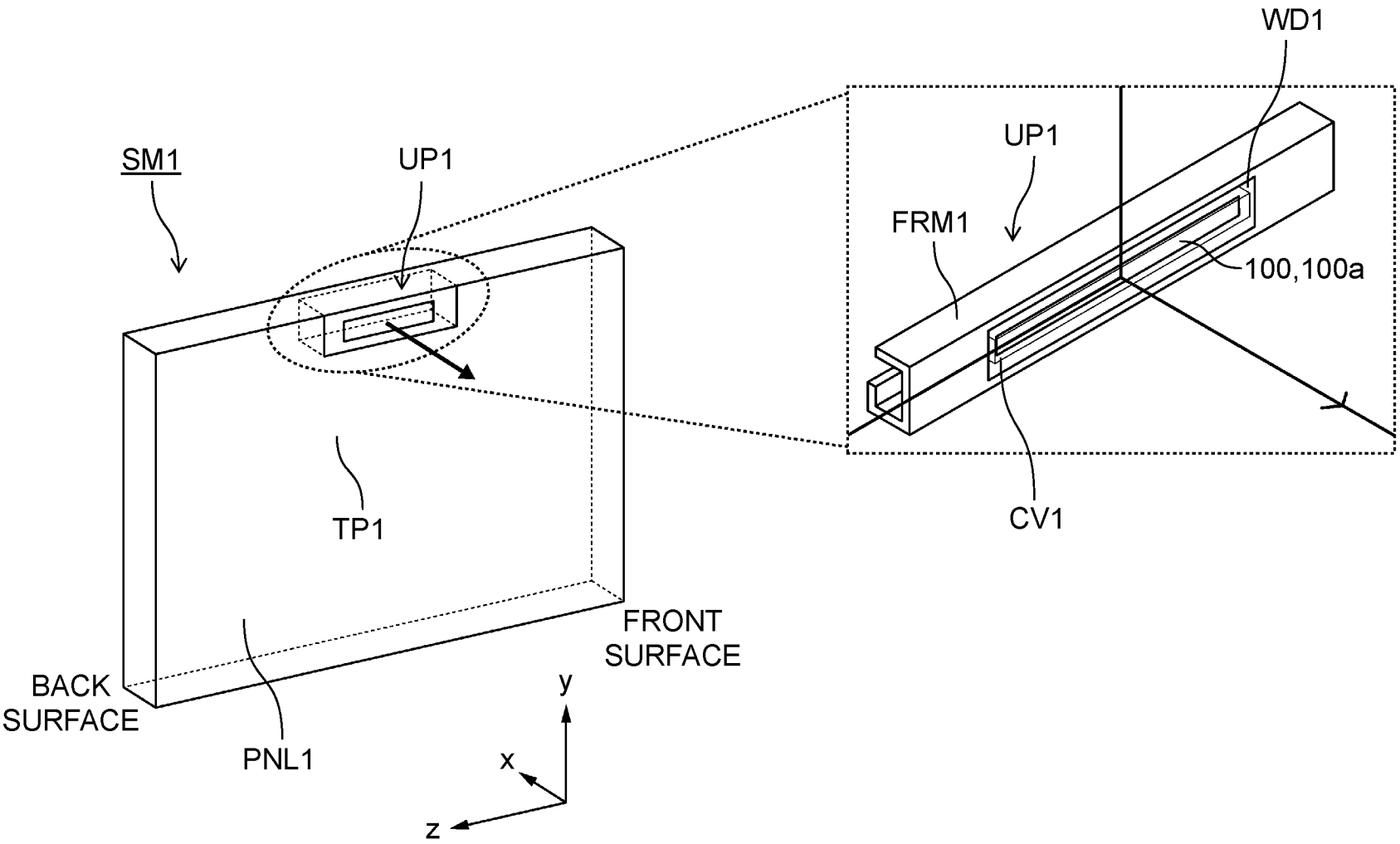
FIG. 1 is a perspective view illustrating an appearance of a communication device equipped with an antenna device according to a first exemplary embodiment.
Figure 2:
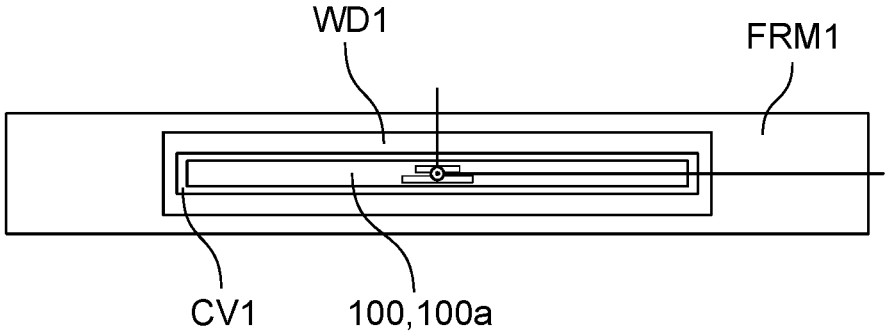
FIG. 2 is a front view of a monitor upper central part illustrated in FIG. 1.

FIG. 1 is a perspective view illustrating an appearance of communication device SM1 equipped with antenna device 100 according to the first exemplary embodiment. FIG. 2 is a front view of monitor upper central part UP1 illustrated in FIG. 1. In the following description, an x-axis, a y-axis, and a z-axis are in directions illustrated in FIG. 1. The x-axis indicates a thickness direction of antenna device 100 or communication device SM1. The y-axis indicates a width direction of antenna device 100 or communication device SM1. The z-axis indicates a longitudinal direction of antenna device 100 or communication device SM1.

Communication device SM1 illustrated in FIG. 1 is, for example, a seat monitor attached to a back surface of a passenger seat in an aircraft in which Bluetooth (registered trademark) wireless communication is available. Communication device SM1 in which antenna device 100 is disposed is not limited to the seat monitor described above. As illustrated in FIG. 1, touch panel TP1 (an example of a display) using panel PNL1 such as glass is provided on a front surface side of communication device SM1. Communication device SM1 is used in a state where a passenger being a user sits on a passenger seat while facing (opposing) touch panel TP1. That is, communication device SM1 displays data such as an image on touch panel TP1 or receives an operation performed on touch panel TP1 using a user's finger or the like. Communication device SM1 also can perform Bluetooth (registered trademark) wireless communication with a communication device (not illustrated) such as a smartphone or a tablet held by the user using antenna device 100.

Printed-circuit board 1 (see FIG. 4) on which antenna device 100 is mounted is surrounded by protective resin cover CV1. Antenna device 100 is fixedly disposed at monitor upper central part UP1 of a housing of communication device SM1. Antenna device 100 radiates an electromagnetic wave in the 2.4 GHz band of Bluetooth (registered trademark) from a front surface (e.g., panel PNL1) of communication device SM1 toward a front direction (see FIGS. 10 and 11) of a rear passenger seat. A detailed configuration example of antenna device 100 will be described later.

FIG. 1 also illustrates a main part of monitor upper central part UP1. Monitor upper central part UP1 includes metal frame FRM1 bonded and fixed to a back surface of panel PNL1 such as glass. The main part of monitor upper central part UP1 in FIG. 1 and panel PNL1 are not illustrated in FIG. 2. Metal frame FRM1 is a hollow metal structure in a substantially rectangular parallelepiped shape having a section that is taken along the x-axis and has a hollow substantially rectangular shape. For example, metal frame FRM1 in FIG. 1 has a shape in which end portions of four different rectangular metal pieces are joined at right angles to the corresponding adjacent metal pieces by welding or the like.

Metal frame FRM1 includes an opening (e.g., front window portion WD1) having a larger area than antenna device 100 and resin cover CV1 in a yz-plane. That is, metal frame FRM1 is provided in its front surface with the opening (e.g., front window portion WD1). Metal frame FRM1 surrounds antenna device 100 with the four different metal pieces (see FIGS. 2 and 3). That is, antenna device 100 is surrounded by metal frame FRM1, and thus is likely to be affected by metal. This causes a concern that performance (e.g., frequency characteristics of a gain or a VSWR) as an antenna may be deteriorated.

Thus, antenna device 100 according to the first exemplary embodiment is bonded to panel PNL1 using double-sided tape TPE1 (see FIG. 3) without contact of a front surface of antenna device 100 with front window portion WD1 of metal frame FRM1 to reduce deterioration in performance (e.g., gain or frequency characteristics of a VSWR) as an antenna. This allows antenna device 100 to be directly fixed to panel PNL1 using double-sided tape TPE1, so that antenna device 100 can reduce influence of metal frame FRM1.

Figure 3:
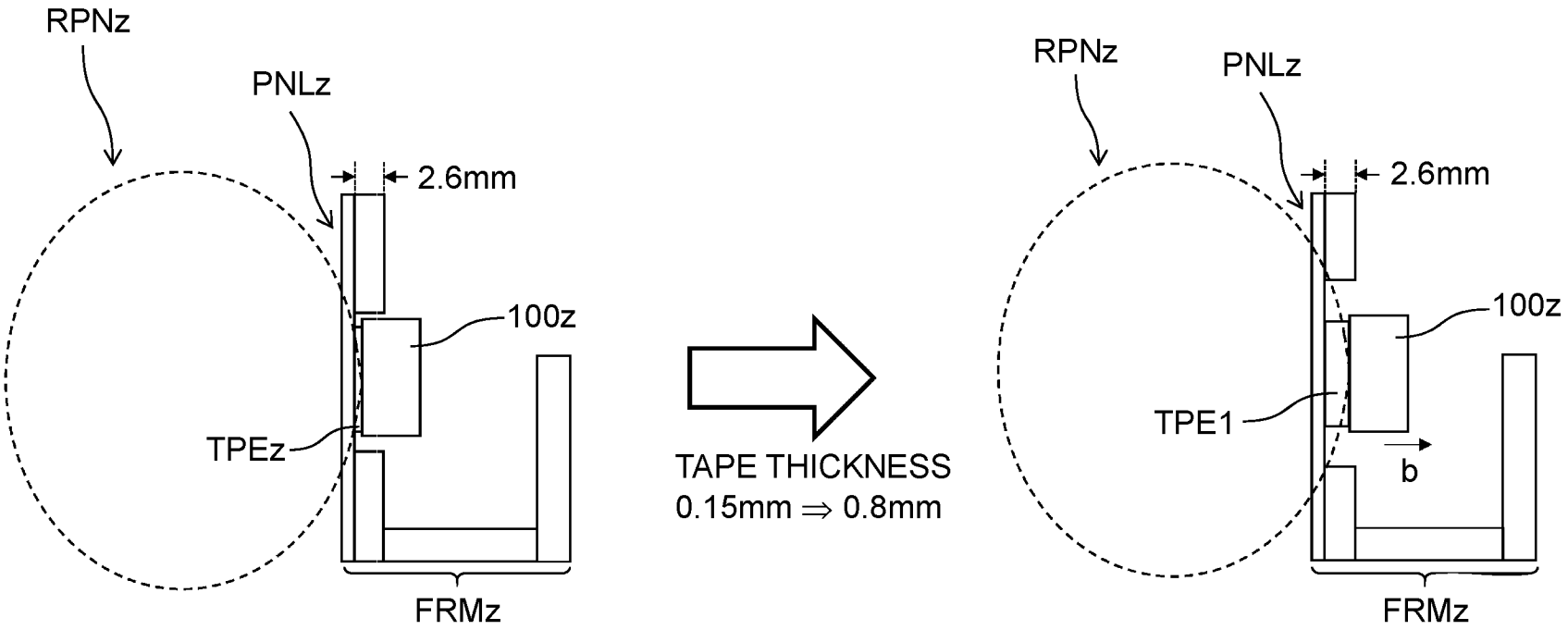
FIG. 3 is a side view illustrating an example of a change in thickness of a double-sided tape for bonding an antenna device and a panel according to a comparative example.

FIG. 3 is a side view illustrating an example of a change in thickness of double-sided tape TPEz for bonding antenna device 100*z* to panel PNLz according to the comparative example. A detailed configuration example of antenna device 100*z* according to the comparative example will be described later with reference to FIG. 7.

Antenna device 100*z* is covered with metal frame FRMz having a substantially U-shape turned sideways in a section taken along the x-axis, and is adhesively fixed to panel PNLz such as glass using double-sided tape TPEz. Metal frame FRMz has a thickness of 2.6 mm in its front portion that is adhesively fixed to panel PNLz. Double-sided tape TPEz has a thickness of 0.15 mm, so that antenna device 100*z* has a feeding point located on a considerably front surface side (a position close to panel PNLz) with respect to metal frame FRMz having a thickness of 2.6 mm. As a result, even when antenna device 100*z* is covered with metal frame FRMz, deterioration in performance (e.g., gain) as an antenna is not so much observed as can be seen from radiation pattern RPNz from antenna device 100*z*.

However, consideration at the time of design assuming actual use results has found that using double-sided tape TPEz having a thickness of 0.15 mm causes mechanical reliability when antenna device 100*z* is fixed at a position, such as that antenna device 100*z* is less likely to drop or to be displaced, to be insufficient.

Then, as a background to the first exemplary embodiment, double-sided tape TPEz is changed in thickness from a conventional thickness of 0.15 mm to 0.8 mm, and antenna device 100 is adhesively fixed to panel PNL1 using double-sided tape TPE1 having a thickness of 0.8 mm. This estimates that the mechanical reliability (see the above) when antenna device 100*z* is fixed at a position can be secured. However, double-sided tape TPE1 increased in thickness from 0.15 mm to 0.8 mm causes antenna device 100*z* to be further separated from panel PNLz (i.e., antenna device 100*z* is displaced in direction b illustrated in FIG. 3). This causes antenna device 100*z* to be affected by metal frame FRMz (particularly, a front side of the metal frame that is bonded to panel PNLz), so that radiation pattern RPNz of antenna device 100*z* is deteriorated.

Based on the background described above, an example of antenna devices 100 (see FIG. 6), 100*a* (see FIG. 7) will be described in which influence of surrounding metal frame FRM1 is reduced to reduce deterioration of performance (e.g., gain or frequency characteristics of a VSWR) as an antenna even when antenna device 100, 100*a* is adhesively fixed to the back surface of panel PNL1 using double-sided tape TPE1 having a thickness of about 0.8 mm, or even when the antenna is separated from panel PNL1.

Figure 4:
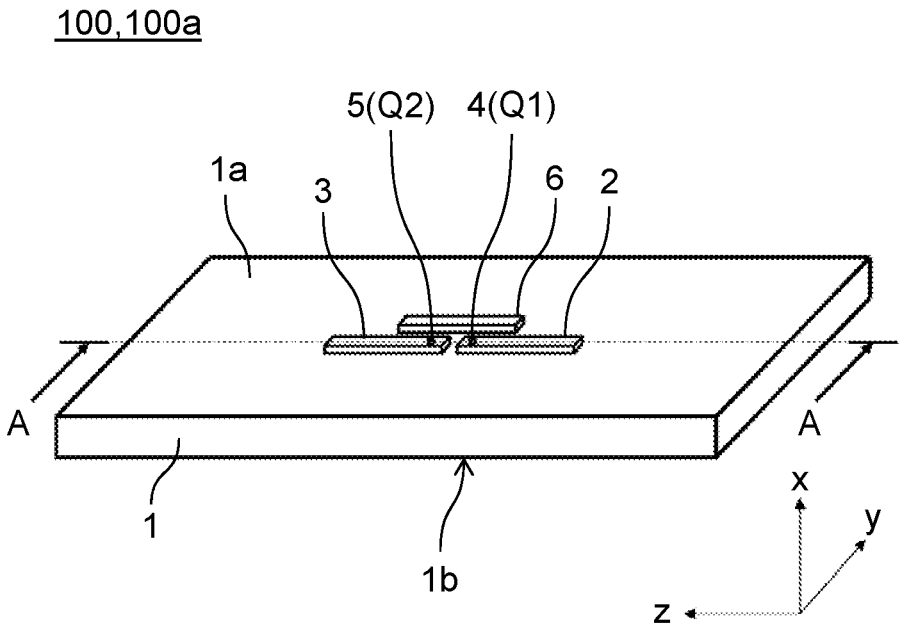
FIG. 4 is a perspective view illustrating an outer appearance of the antenna device according to the first exemplary embodiment.
Figure 5:
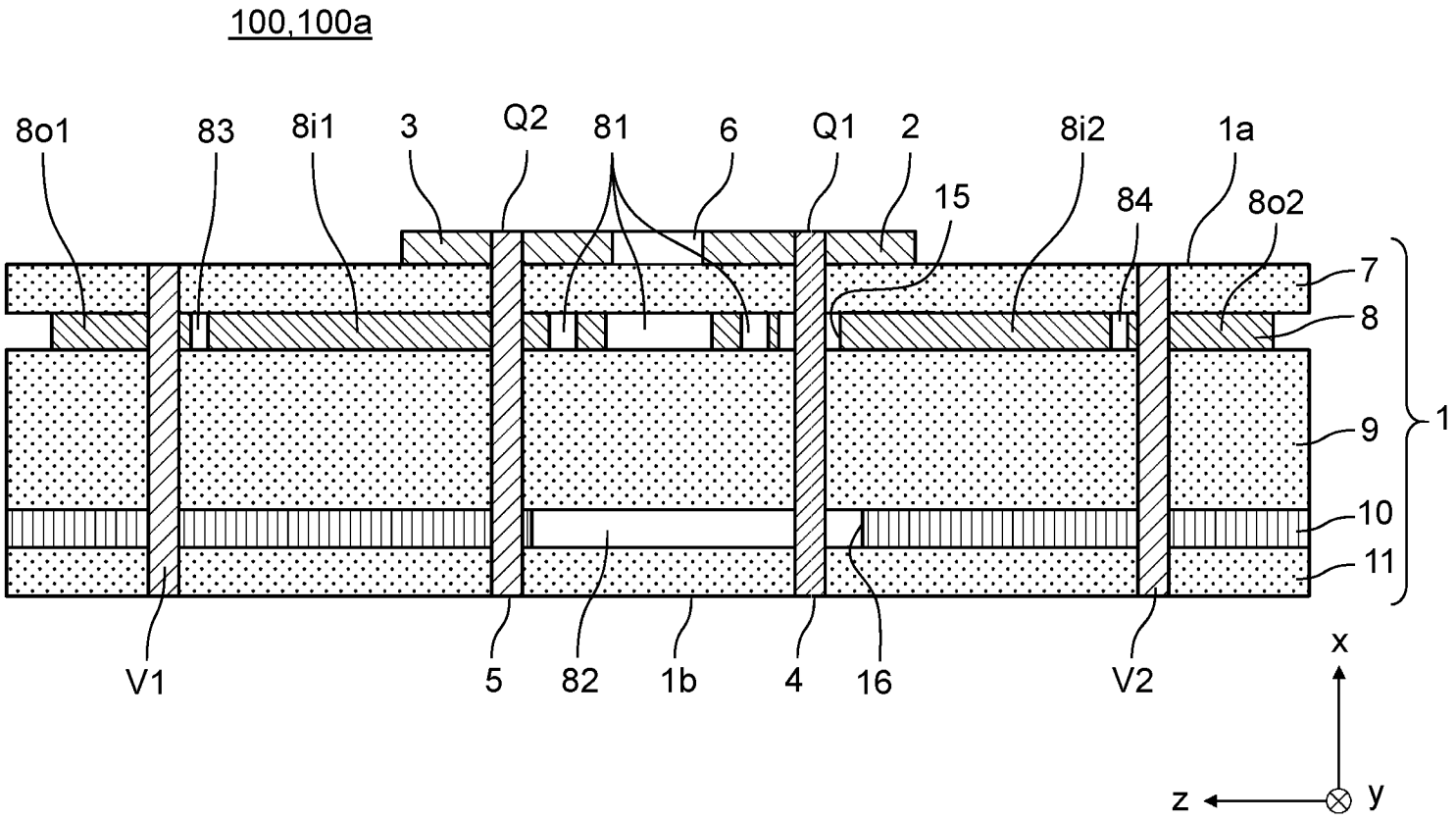
FIG. 5 is a longitudinal sectional view illustrating an internal structure of the antenna device taken along line A-A of FIG. 4.
Figure 6:
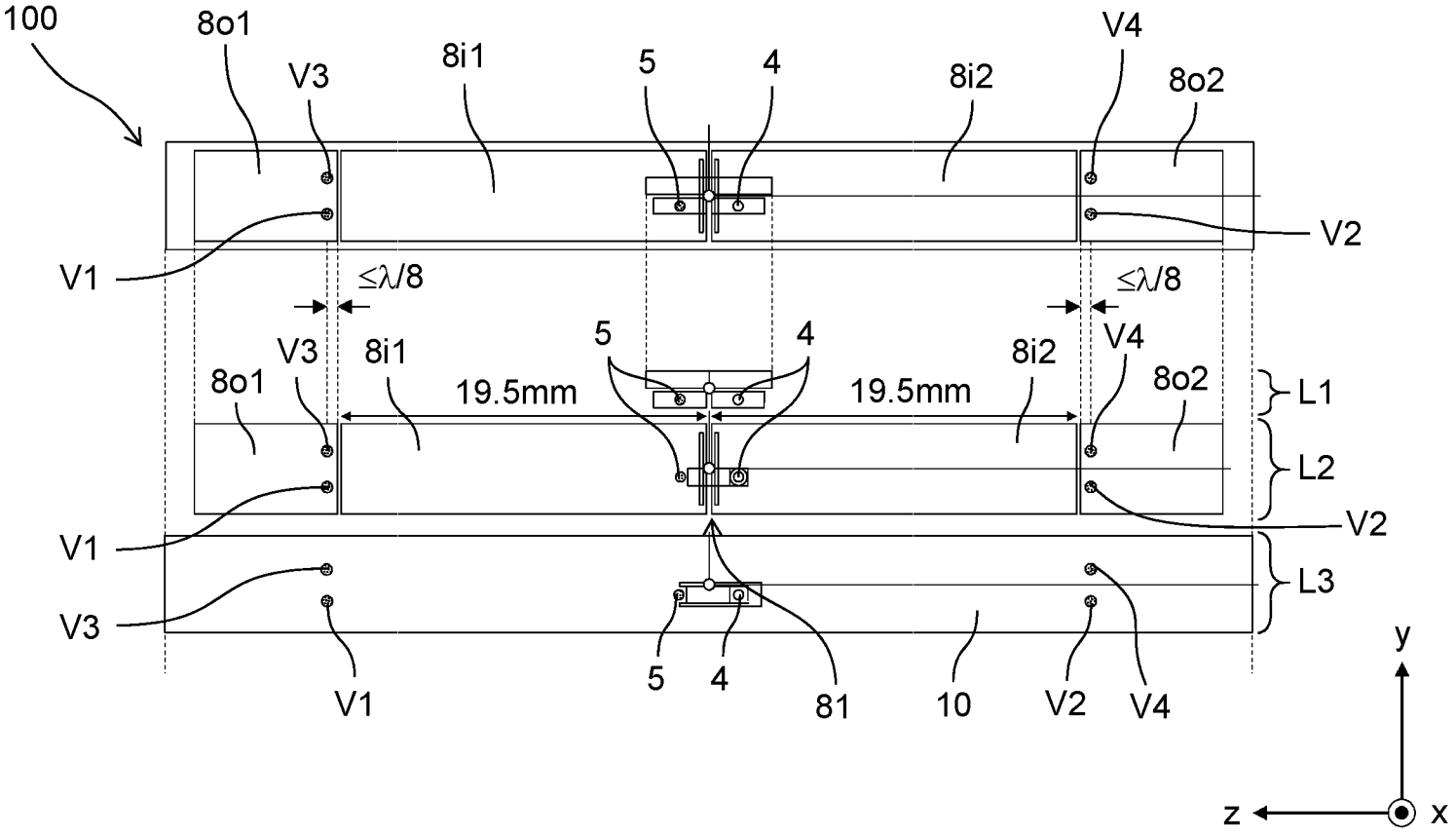
FIG. 6 is a diagram illustrating an example of a layer configuration of the antenna device according to the first exemplary embodiment.
Figure 7:
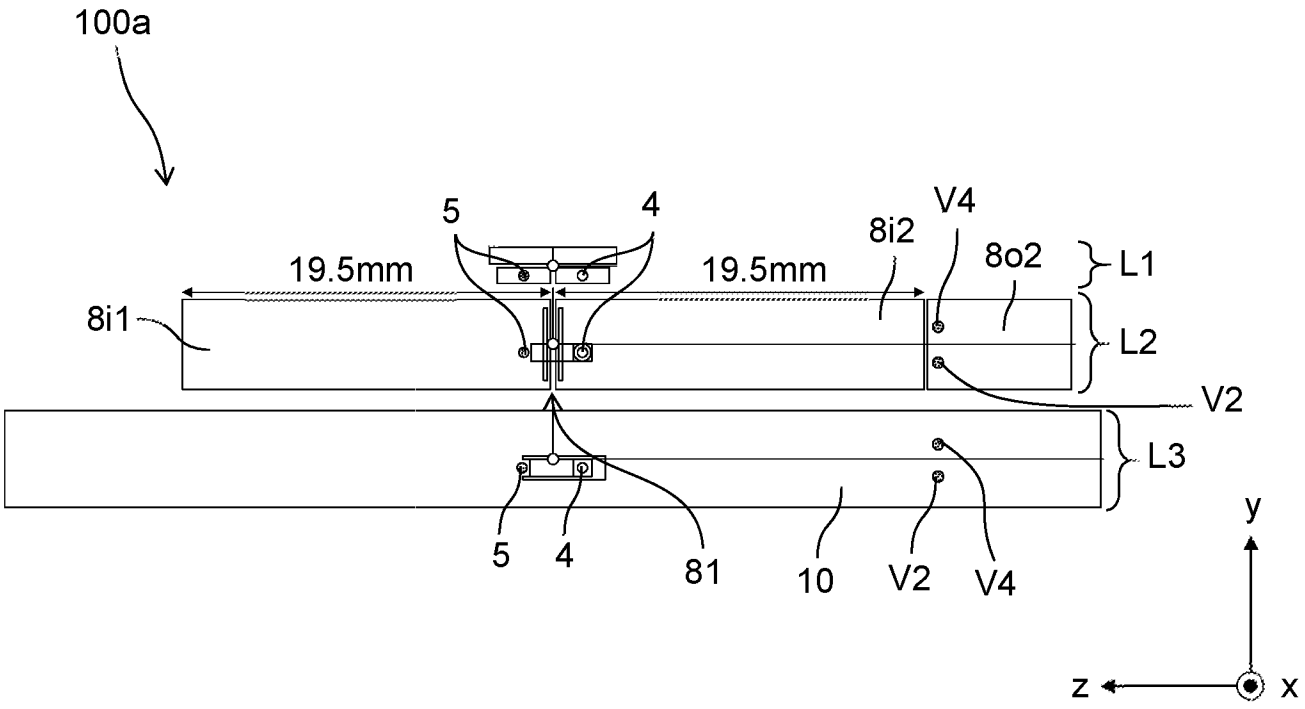
FIG. 7 is a diagram illustrating an example of a layer configuration of the antenna device according to the first exemplary embodiment.
Figure 8:
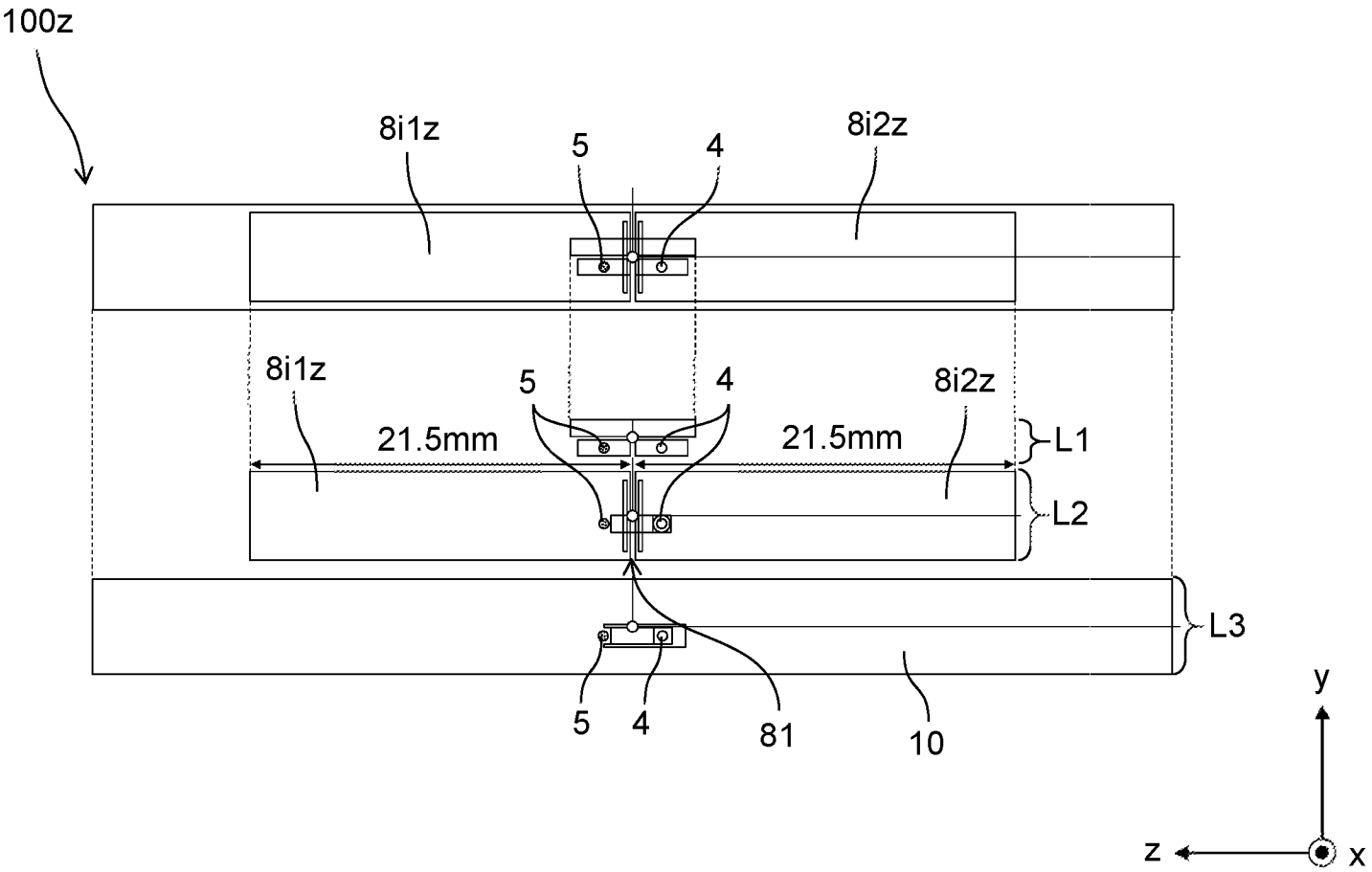
FIG. 8 is a diagram illustrating an example of a layer configuration of an antenna device according to a comparative example.

FIG. 4 is a perspective view illustrating an outer appearance of antenna device 100 according to the first exemplary embodiment. FIG. 5 is a longitudinal sectional view illustrating an internal structure of antenna device 100 taken along line A-A of FIG. 4. FIG. 6 is a diagram illustrating an example of a layer configuration of antenna device 100 according to the first exemplary embodiment. FIG. 7 is a diagram illustrating an example of a layer configuration of antenna device 100*a* according to the first exemplary embodiment. FIG. 8 is a diagram illustrating an example of a layer configuration of antenna device 100*z* according to a comparative example. In FIGS. 4 to 8, an x-axis, a y-axis, and a z-axis follow the illustration of FIG. 1.

As an example of antenna devices 100, 100*a*, 100*z*, a dipole antenna will be described. The dipole antenna is formed on printed-circuit board 1 that is a layered board having multiple layers. The dipole antenna has a pattern that is formed by etching metal foil on a surface of printed-circuit board 1, for example. The multiple layers are each made of copper foil or glass epoxy, for example. Antenna device 100, 100*a*, 100*z* includes at least antenna layer L1, AMC layer L2, and ground layer L3.

As illustrated in FIG. 4, antenna device 100, 100*a* includes printed-circuit board 1, antenna conductor 2 that is a strip conductor as an example of a feeding antenna, antenna conductor 3 that is a strip conductor as an example of a non-feeding antenna, and parasitic conductor 6 that is disposed laterally to antenna conductors 2, 3. Printed-circuit board 1 of antenna device 100, 100*a* is disposed in monitor upper central part UP1 of communication device SM1 such as a seat monitor (see FIG. 1).

Antenna conductors 2, 3 are connected to via conductors 4, 5 of printed-circuit board 1, respectively. Via conductor 4 (an example of a third via conductor) is formed using, for example, copper foil with conductivity, and constitutes a feeder between feeding point Q1 of antenna conductor 2 and a wireless communication circuit (not illustrated; e.g., a signal source circuit mounted on back surface 1*b* of printed-circuit board 1). Via conductor 5 (an example of a fourth via conductor) is formed using, for example, copper foil with conductivity, and constitutes a ground line between feeding point Q2 of antenna conductor 3 and the above-described wireless communication circuit (not illustrated).

Antenna conductors 2, 3 each have a substantially rectangular shape (including a rectangular shape), forming a dipole antenna, for example, and each have a longitudinal direction extending on a straight line in a z-direction. Antenna conductors 2, 3 have ends (i.e., feeding-side ends) close to their feeding points Q1 and Q2 facing each other, respectively. Antenna conductors 2, 3 are formed on front surface 1*a* of printed-circuit board 1 having the two ends separated by a predetermined interval to minimize cancellation of electromagnetic waves emitted from antenna conductors 2, 3.

Antenna conductors 2, 3 have ends opposite to the corresponding feeding-side ends (specifically, the ends separated maximumly from each other when antenna device 100, 100*a* is viewed in plan in the yz-plane) that are referred to below as "leading-end-side ends" of antenna conductors 2, 3.

Parasitic conductor 6 is disposed parallel to a placement direction (z-direction) of each of antenna conductors 2, 3, and is disposed close to one of side surfaces of each of antenna conductors 2, 3 to be electrically separated from antenna conductors 2, 3. A predetermined distance is secured between parasitic conductor 6 and antenna conductor 2 as well as between parasitic conductor 6 and antenna conductor 3 to similarly minimize cancellation of electromagnetic waves radiated from antenna conductors 2, 3. The predetermined distance is, for example, within a quarter of one wavelength of electromagnetic waves in an operating frequency band supported by antenna devices 100, 100*a*. Parasitic conductor 6 is electrostatically coupled to AMC 8 as with antenna conductors 2, 3, so that capacitance between antenna conductors 2, 3 and AMC 8 can be increased to shift an operating frequency to a low-frequency side. Parasitic conductor 6 is electrically separated from antenna conductors 2 and 3.

Parasitic conductor 6 is not particularly limited in size, shape, number, etc., and parasitic conductor 6 is only required to be electrostatically coupled to AMC 8 while being located on the same side as antenna conductors 2, 3 when viewed from AMC 8. Only antenna conductors 2, 3 may be disposed on front surface 1*a* of printed-circuit board 1 without disposing parasitic conductor 6 on AMC 8.

Via conductors 4, 5 are each formed by filling a conductor such as copper foil in a through-hole formed in the thickness direction (x-direction) from front surface 1*a* to back surface 1*b* of printed-circuit board 1. Via conductors 4, 5 are formed directly below feeding points Q1, Q2, respectively, at positions substantially facing each other. Antenna conductor 2 functions as a feeding antenna, and thus is connected to a feeding terminal of the wireless communication circuit (refer to the above description) on back surface 1*b* of printed-circuit board 1 with via conductor 4. Antenna conductor 3 functions as a non-feeding antenna, and thus is connected to ground conductor 10 in printed-circuit board 1 and a ground terminal of the wireless communication circuit (refer to the above description) with via conductor 5.

FIG. 5 illustrates printed-circuit board 1 that includes dielectric board 7, artificial magnetic conductor (AMC) 8, dielectric board 9, ground conductor 10, and dielectric board 11, being layered. The layered structure of printed-circuit board 1 is an example. Here, each of dielectric boards 7, 9, 11 has insulating properties against a direct-current component, and is made of, for example, glass epoxy.

AMC 8 is an artificial magnetic conductor having perfect magnetic conductor (PMC) characteristics and is formed of a predetermined metal pattern. AMC 8 is electrostatically coupled to each of antenna conductors 2, 3 and parasitic conductor 6, and thus enables the antenna to be thin and to have a high gain. AMC 8 is provided in its intermediate portion between via conductors 4, 5 facing in a z-axis direction with slit 81 that passes through AMC 8 in the thickness direction (x-axis direction) and extends to near an end of AMC 8 in the width direction (y-axis direction) (see FIGS. 6 to 8). In the first exemplary embodiment, slit 81 has a shape in which three slits are connected in a central portion in the width direction (see FIGS. 6 to 8).

AMC 8 also includes a hole for slit 81, via conductor insulating hole 15 formed to allow via conductor 4 to pass through while being electrically insulated from inner AMC 8*i*2 (see description below), and a hole formed to allow via conductor 5 to pass through while being electrically connected to inner AMC 8*i*1 (see description below). AMC 8 further includes holes formed to allow corresponding via conductors V1, V2 (see description below) to pass through while being electrically connected to corresponding outer AMCs 8*o*1, 8*o*2 (see description below). As illustrated in FIG. 5, via conductor V2 (an example of a first via conductor) electrically connects outer AMC 8*o*2 (an example of a second artificial magnetic conductor) to ground conductor 10. Via conductor V1 (an example of a second via conductor) electrically connects outer AMC 8*o*1 (an example of a third artificial magnetic conductor) to ground conductor 10. Inner AMC 8*i*1 and inner AMC 8*i*2 (an example of a first artificial magnetic conductor) are disposed between outer AMC 8*o*2 and outer AMC 8*o*1.

Via conductor 4 has a cylindrical shape and is a feeder line for supplying power for driving antenna conductor 2 as an antenna. Via conductor 4 electrically connects antenna conductor 2 formed on front surface 1*a* of printed-circuit board 1 to a feeding terminal of the wireless communication circuit (see above). Via conductor 4 is formed substantially coaxially with via conductor insulating holes 15, 16 formed in AMC 8 and ground conductor 10, respectively, to be not electrically connected to AMC 8 and ground conductor 10. Thus, via conductor 4 has a diameter smaller than a diameter of each of via conductor insulating holes 15, 16.

Via conductor 5 is a ground line that has a cylindrical shape and electrically connects antenna conductor 3 to the ground terminal of the wireless communication circuit (see the above). Via conductor 5 electrically connects antenna conductor 3 formed on front surface 1*a* of printed-circuit board 1 to the ground terminal of the wireless communication circuit (see the above). Via conductor 5 is electrically connected to each of AMC 8 and ground conductor 10.

Ground conductor 10 is formed using conductive copper foil. Ground conductor 10 includes via conductor insulating hole 16 formed to allow via conductor 4 to pass through while being electrically insulated from ground conductor 10, connector terminal connection hole 82 provided facing slit 81, a first hole formed to allow via conductor 5 to pass through while being electrically connected to ground conductor 10, and a second hole formed to allow via conductor V1, V2 (see description below) to pass through while being electrically connected to ground conductor 10. Connector terminal connection hole 82 is provided for alignment when facing and being fixed to a connector terminal of the wireless communication circuit (see the above).

Antenna devices 100, 100*a* (See FIGS. 6 and 7) according to the first exemplary embodiment are different from antenna device 100*z* (see FIG. 8) according to the comparative example in length from antenna conductors 2, 3 to the end of AMC 8. Antenna devices 100, 100*a* each include outer AMCs 8*o*1, 8*o*2 electrically connected to ground conductor 10 using via conductors V1, V2, respectively, in addition to inner AMCs 8*i*1, 8*i*2 provided at respective ends with slits 81. Antenna devices 100, 100*a* (see FIGS. 6 and 7) according to the first exemplary embodiment each have a length of 19.5 mm from each of antenna conductors 2, 3 to corresponding one of ends of inner AMCs 8*i*1, 8*i*2. Antenna device 100*z* (see FIG. 8) according to the comparative example has a length of 21.5 mm from each of antenna conductors 2, 3 to corresponding one of ends of AMCs 8*i*1*z*, 8*i*2*z*.

In other words, antenna device 100*z* is different from antenna device 100, 100*a* in a number (or area) of AMCs 8. As a result, a number (or area) of AMCs 8 of a placement pattern of each of antenna devices 100, 100*a* is larger (wider) than a number of AMCs of a placement pattern of antenna device 100*z* by a number of outer AMC 8*o*2 or outer AMCs 8*o*1, 8*o*2. As will be described later, providing these outer AMCs enables antenna devices 100,100*a* according to the first exemplary embodiment to reduce deterioration of performance (e.g., gain or frequency characteristics of a VSWR) as an antenna even when the antenna devices are adhesively fixed using double-sided tape TPE1 having a thickness of 0.8 mm as illustrated in FIG. 3 (see FIGS. 12 and 13). As illustrated in FIG. 7, it is found that providing only at least one of outer AMCs 8*o*1 and 8*o*2 (specifically, outer AMC 8*o*2 close to feeding point Q1) enables deterioration of performance as an antenna (e.g., gain or frequency characteristics of a VSWR) to be similarly reduced.

Via conductors V1, V3 each have a cylindrical shape, and are each provided at a position separated from antenna conductor 3 by, for example, 19.5 mm while passing through dielectric board 7, outer AMC 8*o*1, dielectric board 9, ground conductor 10, and dielectric board 11. Via conductors V1, V3 are each formed using conductive copper foil, and each constitute a ground line between outer AMC 8*o*1 and ground conductor 10 (see FIGS. 5 and 6). Outer AMC 8*o*1 is provided apart from inner AMC 8*i*1 across gap 83 with a predetermined length. For example, gap 83 has a width that is ⅛ or less of a wavelength of electromagnetic waves in the operating frequency band. Via conductors V1, V3 are provided at positions separated by a predetermined length from the end (the leading-end-side end described above) of inner AMC 8*i*1 closest to outer AMC 8*o*1. Here, the predetermined length is, for example, ⅛ or less of the wavelength of the electromagnetic waves in the operating frequency band.

Similarly, via conductors V2, V4 each have a cylindrical shape, and are each provided at a position separated from antenna conductor 2 by, for example, 19.5 mm while passing through dielectric board 7, outer AMC 8*o*2, dielectric board 9, ground conductor 10, and dielectric board 11. Via conductors V2, V4 are each formed using conductive copper foil, and each constitute a ground line between outer AMC 8*o*2 and ground conductor 10 (see FIG. 5). Outer AMC 8*o*2 is provided apart from inner AMC 8*i*2 across gap 84 with a predetermined length. As with gap 83, gap 84 has a width of about 0.2 mm, for example. Via conductor V2, V4 are each provided at a position separated by a predetermined length from the end (the leading-end-side end described above) of inner AMC 8*i*2 closest to outer AMC 8*o*2. Here, the predetermined length is, for example, ⅛ or less of the wavelength of the electromagnetic waves in the operating frequency band.

The first exemplary embodiment includes outer AMCs 8*o*1 and 8*o*2 that are electrically connected to ground conductor 10 using via conductors V1, V2, respectively. As a result, as compared with when outer AMCs 8*o*1, 8*o*2 are not provided (see FIG. 8), influence of surrounding metal frame FRM1 can be reduced, and the performance (e.g., gain) of antenna device 100 can be improved in the operating frequency band (see FIG. 12) even when antenna device 100 is bonded to panel PNL1 with double-sided tape TPE1 having a thickness of about 0.8 mm. Antenna device 100 enables shifting the operating frequency band to the low-frequency side to match or approach an ideal operation frequency conforming to the Bluetooth (registered trademark) standard. This means that an operating frequency at which a minimum value (peak) is obtained is shifted to the low-frequency side in VSWR characteristics of FIG. 13, for example. It is considered that the shift to the low-frequency side is caused by increase in a path (area) of a current flowing from antenna conductor 3 to AMC 8 and ground conductor 10 when outer AMCs 8*o*1, 8*o*2 that are each electrically connected to ground conductor 10 are provided, for example.

Figure 9A:
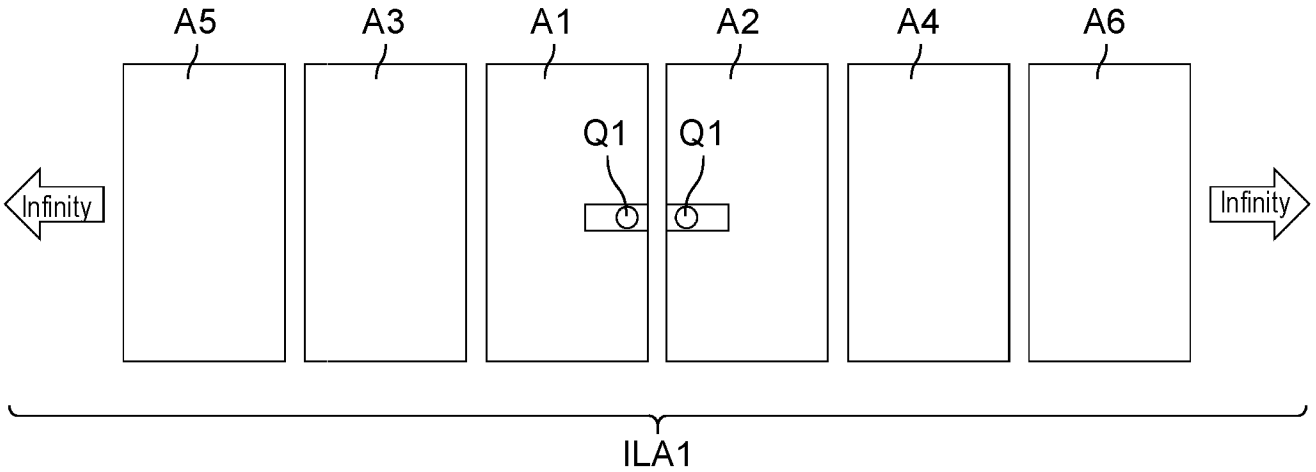
FIG. 9A is a diagram schematically illustrating a concept of a multistage AMC.

FIG. 9A is a diagram schematically illustrating a concept of a multistage AMC. When an AMC is used for an antenna device, the AMC is formed to have characteristics of a perfect magnetic conductor (PMC) in an operating frequency band of the antenna device. The perfect magnetic conductor has very high surface impedance characteristics, and thus has characteristics in which a tangential component of a magnetic field on its surface is zero. This enables the AMC to prevent electromagnetic waves having a frequency in the operating frequency band of the antenna device from propagating along a surface of the AMC. As a result, unnecessary radiation from the AMC to an antenna element is reduced, so that performance as the antenna device can be improved.

Thus, as illustrated in FIG. 9A, in addition to AMC patterns A1, A2 in each of which an antenna conductor provided with feeding point Q1 is disposed, when AMC patterns A3, A5, . . . , are disposed next to AMC pattern A1, and AMC patterns A4, A6, . . . , are disposed next to AMC pattern A2, in parallel with each other, to form a multistage AMC, antenna device ILA1 having ideal performance can be obtained. That is, when AMC patterns are disposed in an infinite period, an operating frequency band of antenna device ILA1 is widened, and gain is also improved. The multistage here means that a plurality of AMC patterns is disposed adjacent to each other in an antenna device.

However, such antenna device ILA1 increases the number of AMC patterns or widens an area thereof, and thus causes a problem that downsizing is difficult. For example, a placement space of an antenna device provided in a device is limited in many cases as in communication device SM1 or the like.

Figure 9B:
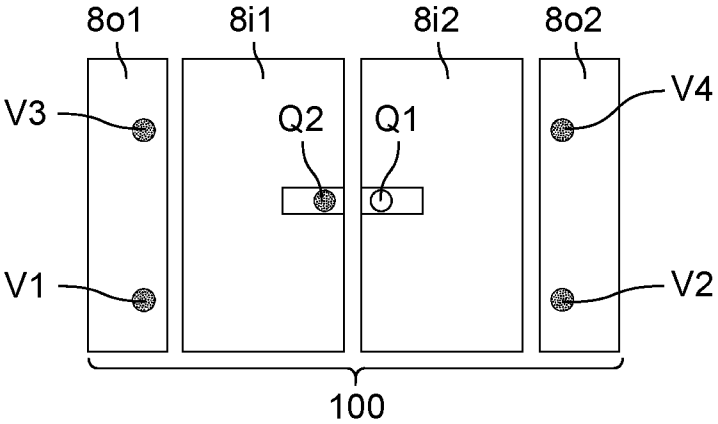
FIG. 9B is a diagram illustrating a multistage AMC according to the first exemplary embodiment.

Thus, antenna device 100 according to the first exemplary embodiment is configured as illustrated in FIG. 9B to enable downsizing. Specifically, outer AMCs 8*o*2, 8*o*1 electrically connected to ground conductor 10 are each disposed adjacent to an AMC pattern (specifically, inner AMCs 8*i*2, 8*i*1) in which antenna conductors 2, 3 provided with feeding points Q1, Q2, respectively, are disposed. That is, antenna device 100 according to the first exemplary embodiment includes outer AMCs 8*o*1, 8*o*2 that are added as compared with antenna device 100*z* according to the comparative example. Outer AMC 8*o*1 is electrically connected to ground conductor 10 using via conductors V1, V3. Outer AMC 8*o*2 is electrically connected to ground conductor 10 using via conductors V2, V4. This allows antenna device 100 to have multistage AMC 8 by disposing inner AMCs 8*i*1, 8*i*2 and outer AMCs 8*o*1, 8*o*2 side by side. Thus, even when a metal structure such as metal frame FRM1 is disposed around antenna device 100, influence of the metal structure is reduced. This improves performance (e.g., gain or frequency characteristics of a VSWR) as an antenna.

Figure 10:
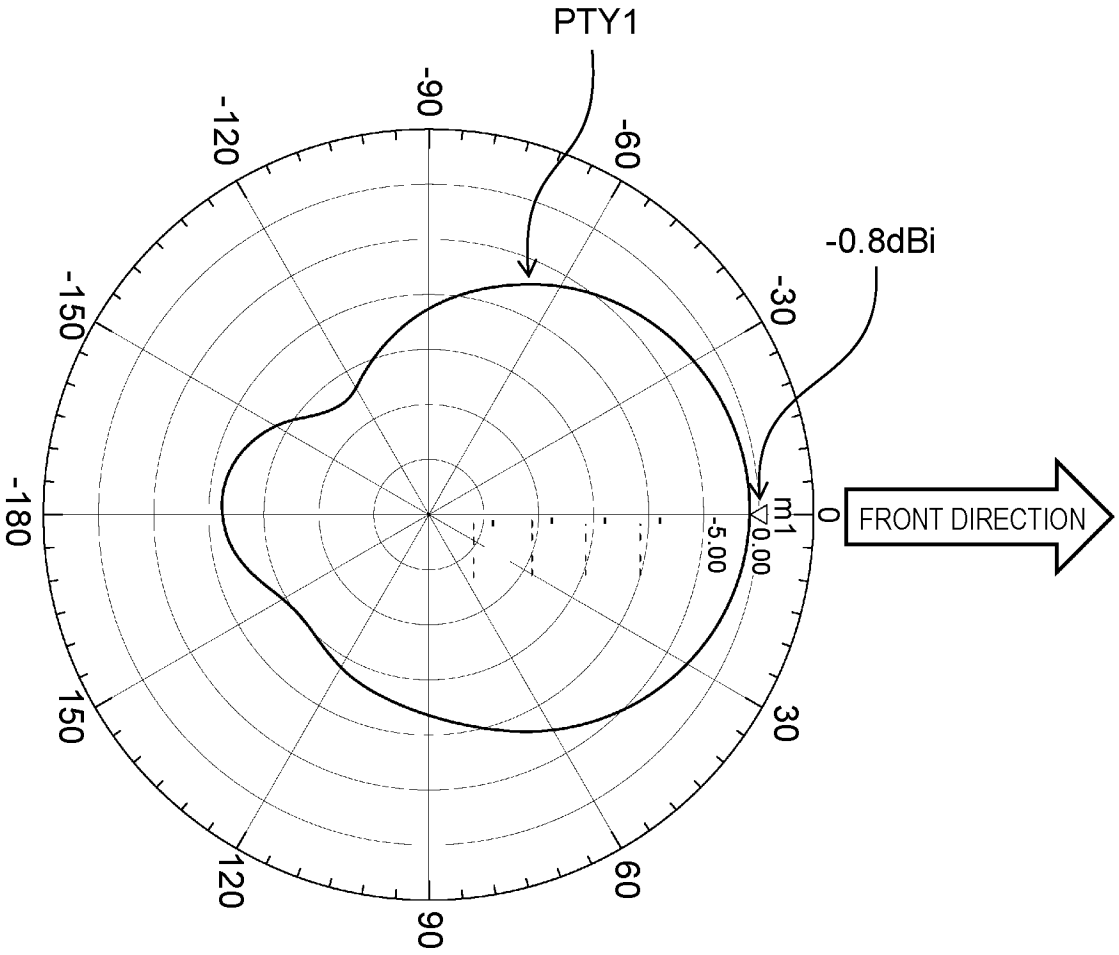
FIG. 10 is a diagram illustrating an example of a simulation result of a radiation pattern of the antenna device according to the first exemplary embodiment.
Figure 11:
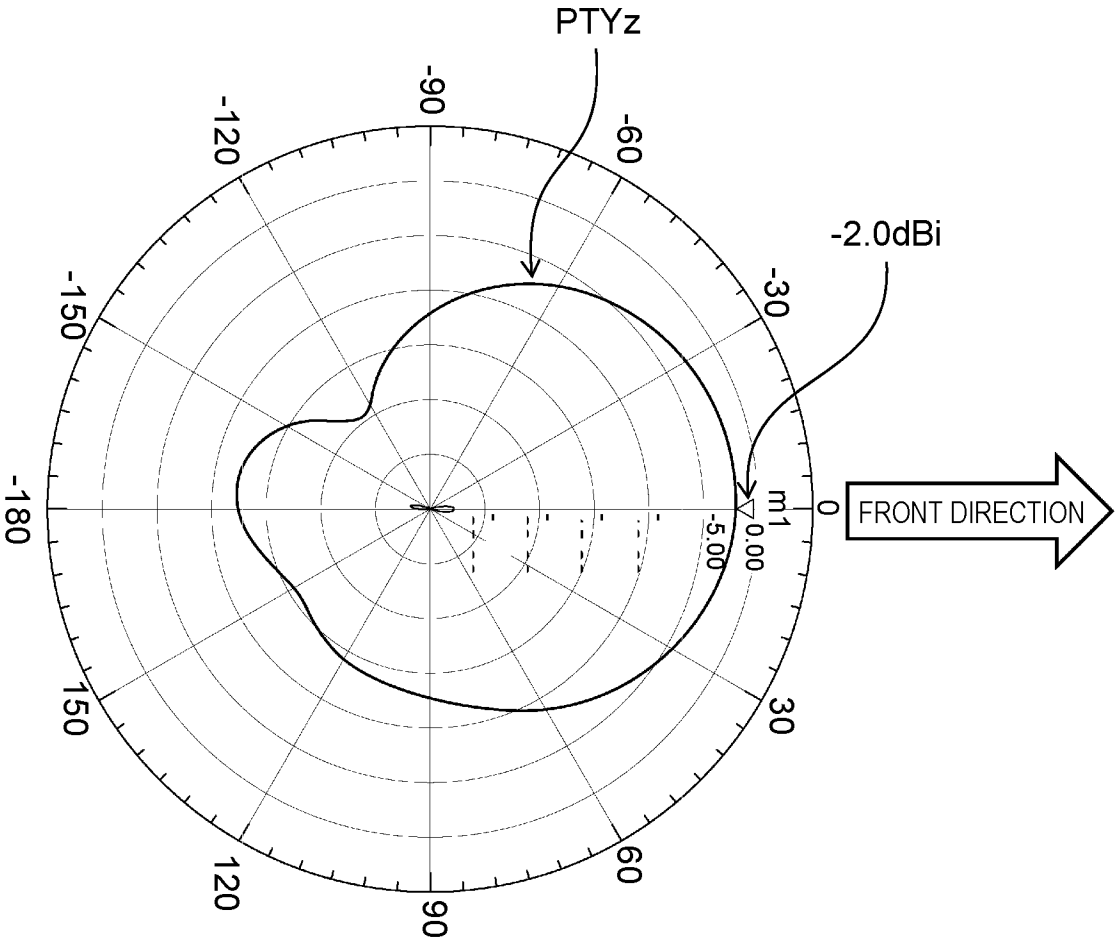
FIG. 11 is a diagram illustrating an example of a simulation result of a radiation pattern of the antenna device according to the comparative example.

FIG. 10 is a diagram illustrating an example of a simulation result of radiation pattern PTY1 of antenna device 100 according to the first exemplary embodiment. FIG. 11 is a diagram illustrating an example of a simulation result of radiation pattern PTYz of antenna device 100*z* according to the comparative example. The radiation pattern indicates intensity (gain) for each azimuth (direction) of electromagnetic waves radiated from the antenna device when a position of the antenna device is defined as the center. FIGS. 10 and 11 each indicate zero degree that indicates the front direction. The front direction here indicates a direction from communication device SM1 toward the rear passenger seat. As illustrated in FIG. 11, radiation pattern PTYz of antenna device 100*z* according to the comparative example has a gain of −2.0 dBi in the front direction. In contrast, as illustrated in FIG. 10, radiation pattern PTY1 of antenna device 100 of the first exemplary embodiment has a gain in the front direction that is improved to −0.8 dBi. That is, antenna device 100 can perform high-gain wireless communication with a communication device possessed by a user in the front direction.

Figure 12:
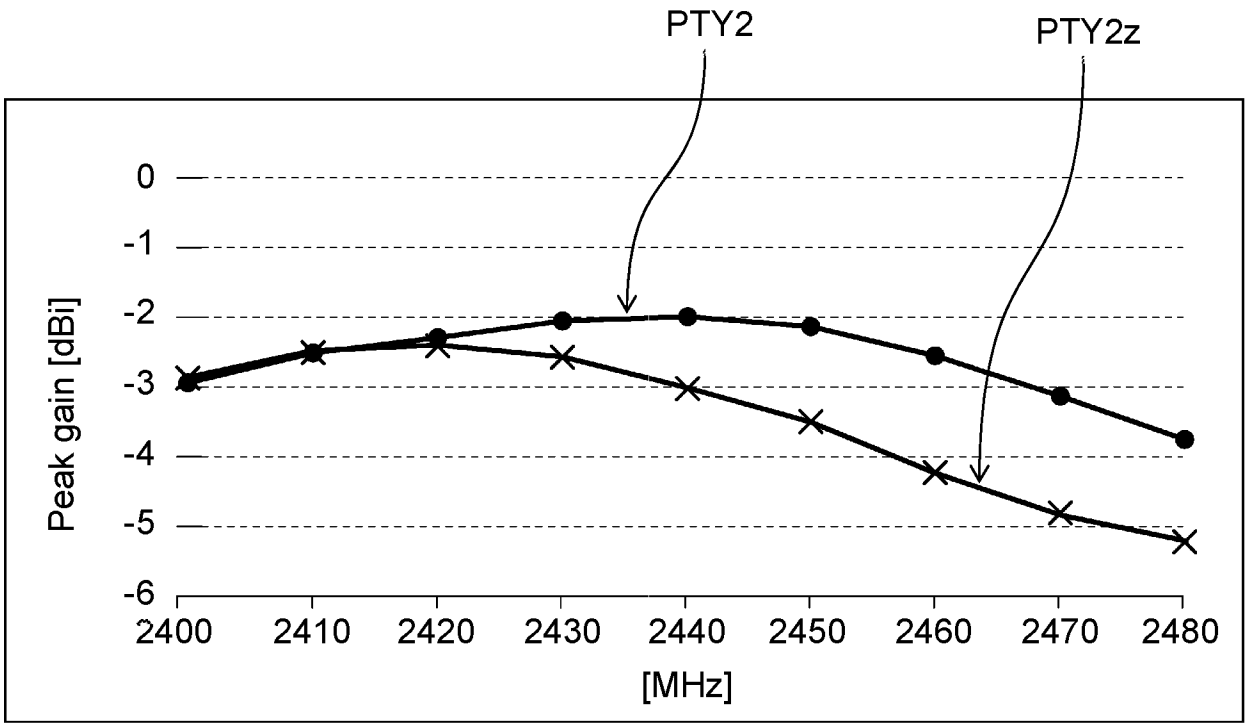
FIG. 12 is a graph illustrating an example of a measurement result of frequency characteristics of peak gains.

FIG. 12 is a graph illustrating an example of measurement results of frequency characteristics PTY2, PTY2*z* of peak gains. FIG. 12 has a horizontal axis representing frequency [MHz], and a vertical axis representing peak gain [dBi]. Frequency characteristics PTY2 indicates peak gain of antenna device 100 according to the first exemplary embodiment, and frequency characteristics PTY2*z* indicates peak gain of antenna device 100*z* according to the comparative example. As illustrated in FIG. 12, when antenna devices 100, 100*z* each have an operating frequency band equal to the frequency band of Bluetooth (registered trademark) (2400 MHz to 2480 MHz), antenna device 100*z* has peak gain decreasing on a high-frequency side (e.g., 2440 MHz to 2480 MHz). In contrast, antenna device 100 has peak gain that stably remains high in the operating frequency band for wireless communication. This enables antenna device 100 to perform high-gain wireless communication in an operating frequency band, which is a target of wireless communication, as compared with antenna device 100*z*.

Figure 13:
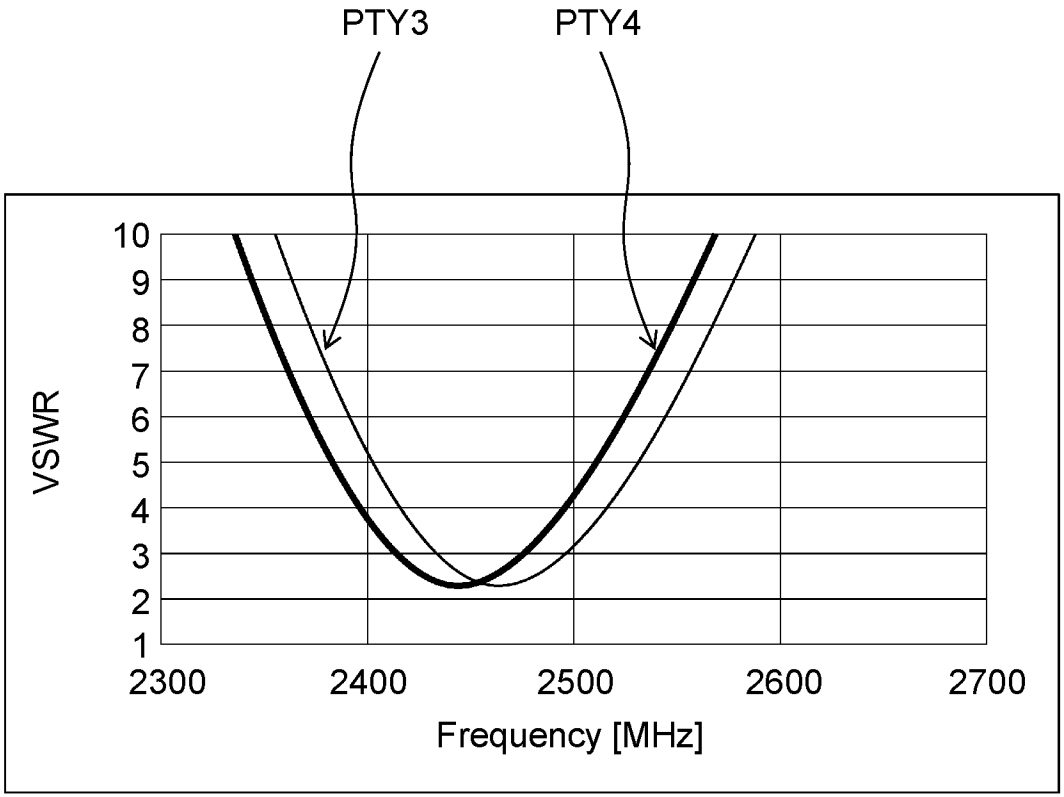
FIG. 13 is a graph illustrating an example of a simulation result of frequency characteristics of voltage standing wave ratios (VSWR).

FIG. 13 is a graph illustrating an example of a simulation result of frequency characteristics PTY3, PTY4 of a VSWR. The VSWR indicates a voltage standing wave ratio in an antenna device. FIG. 13 has a horizontal axis representing frequency [MHz], and a vertical axis representing VSWR. Frequency characteristics PTY3 indicates a VSWR characteristic of antenna device 100*a* (i.e., a configuration in which only outer AMC 8*o*2 is added to inner AMCs 8*i*1, 8*i*2) illustrated in FIG. 7. Frequency characteristics PTY4 indicates a VSWR characteristic of antenna device 100 (i.e., a configuration in which both outer AMCs 8*o*1, 8*o*2 are added to inner AMCs 8*i*1, 8*i*2) illustrated in FIG. 6. As illustrated in FIG. 13, antenna devices 100, 100*a* of the first exemplary embodiment each widens a range in which the VSWR has a value of 3 or less, i.e., the operating frequency band, and achieves a wide range, and then the center of the operating frequency is shifted to the low-frequency side (e.g., near 2450 MHz). This enables an antenna device compatible with a radio frequency of Bluetooth (registered trademark) (2.4 GHz band described above), for example, to be configured. That is, antenna devices 100, 100*a* according to the first exemplary embodiment enable performing wireless communication corresponding to, for example, the radio frequency of Bluetooth (registered trademark) (2.4 GHz band described above).

As described above, antenna devices 100, 100*a* according to the first exemplary embodiment each include a feeding antenna conductor (e.g., antenna conductor 2), a non-feeding antenna conductor (e.g., antenna conductor 3), ground conductor 10, and a first artificial magnetic conductor (e.g., inner AMCs 8*i*1, 8*i*2) interposed between ground conductor 10, and the feeding antenna conductor and the non-feeding antenna conductor. Antenna device 100 also includes at least one second artificial magnetic conductor (e.g., outer AMC 8*o*2) that is disposed in parallel with the first artificial magnetic conductor and electrically connected to ground conductor 10. Communication device SM1 according to the first exemplary embodiment includes antenna device 100, 100*a*, a front panel (e.g., panel PNL1) that protects a display (e.g., touch panel TP1), and metal frame FRM1 that has a window opening (e.g., front window portion WD1) larger in area than a housing of antenna device 100 and surrounds antenna device 100 that is surrounded by the window opening and fixed to a part of the front panel.

This allows antenna devices 100, 100*a* or communication device SM1 to have a substantial multistate AMC 8 (see FIG. 9B) when at least the second artificial magnetic conductor is disposed outside the first artificial magnetic conductor. Thus, even when a metal structure such as metal frame FRM1 is disposed around AMC 8, influence of the metal structure is reduced, and thus performance (e.g., gain or frequency characteristics of a VSWR) as an antenna can be improved. Thus, antenna devices 100, 100*a* each can achieve both widening of the operating frequency and improvement of antenna gain.

The second artificial magnetic conductor is electrically connected to ground conductor 10 using a via conductor (e.g., via conductor V2, V4) provided at a position separated by a predetermined length (e.g., a length of ⅛ or less of a wavelength of the operating frequency band) from an end of the second artificial magnetic conductor on a side close to the first artificial magnetic conductor (e.g., inner AMC 8*i*2) facing the feeding antenna conductor (e.g., antenna conductor 2). This allows the second artificial magnetic conductor to be disposed to be electrically connected to ground conductor 10 near the first artificial magnetic conductor. Thus, the first artificial magnetic conductor and the second artificial magnetic conductor constitute a multistate AMC, and characteristics of antenna devices 100, 100*a* are improved.

Then, two second artificial magnetic conductors are provided. Each second artificial magnetic conductor (e.g., outer AMC 8*o*1, 8*o*2) is disposed outside the closest first artificial magnetic conductor (e.g., inner AMC 8*i*1, 8*i*2). The term, "outside", here refers to a direction away from antenna conductors 2, 3 constituting antenna layer L1. This enables antenna device 100 to shift the operating frequency band to the low-frequency side as compared with antenna device 100*a* in which only one second artificial magnetic conductor is disposed (see FIG. 13).

Antenna device 100 also includes slit 81 of AMC 8, being formed at a position substantially facing a position between the feeding antenna conductor (e.g., antenna conductor 2) and the non-feeding antenna conductor (e.g., antenna conductor 3). This enables antenna device 100 to increase a gain of a downsized dipole antenna.

Antenna device 100 further includes parasitic conductor 6 provided on a board (e.g., dielectric board 7) on which the feeding antenna conductor (e.g., antenna conductor 2) and the non-feeding antenna conductor (e.g., antenna conductor 3) are disposed. This enables parasitic conductor 6 to increase capacitance between antenna conductors 2, 3 and AMC 8 to shift the operating frequency of antenna device 100 to the low-frequency side. Thus, even when antenna device 100 is miniaturized, antenna device 100 can transmit and receive an electromagnetic wave having a radio frequency in the fundamental wave band (2.4 GHz band). Parasitic conductor 6 is electrically insulated from ground conductor 10 and AMC 8.

Although various exemplary embodiments have been described above with reference to the drawings, it is needless to say that the present disclosure is not limited to such examples. It is obvious to those skilled in the art that various modification examples, alteration examples, substitution examples, addition examples, deletion examples, and equivalent examples can be conceived within the scope of claims, and thus it is obviously understood that those examples belong to the technical scope of the present disclosure. Additionally, each component in the various exemplary embodiments described above may be appropriately combined without departing from the spirit of the disclosure.

The first exemplary embodiments described above shows an example in which antenna device 100, 100*a* is mounted in a seat monitor installed in an aircraft. However, the present disclosure is not limited to the seat monitor, and antenna device 100, 100*a* may be mounted in many Internet Of Things (IoT) devices such as a cordless phone master unit or a slave unit, an electronic shelf label (e.g., a card-type electronic device that is attached to a display shelf of a retail store, and displays a selling price of a product), a smart speaker, an in-vehicle device, a microwave oven, and a refrigerator.

Although antenna devices 100, 100*a* according to the first exemplary embodiment described above is described as an example of an antenna device capable of both transmitting and receiving an electromagnetic wave, the present disclosure may be applied to, for example, an antenna device designed for transmission or reception.

The present disclosure is useful as an antenna device and a communication device that achieve both widening of an operating frequency and improvement of an antenna gain even in a placement in which their periphery is covered with a metal structure.

What is claimed is:

1. An antenna device comprising:

a feeding antenna conductor;

a non-feeding antenna conductor;

a ground conductor;

a first artificial magnetic conductor disposed between (i) the feeding antenna conductor and the non-feeding antenna conductor, and (ii) the ground conductor; and a second artificial magnetic conductor disposed side by side with the first artificial magnetic conductor and electrically connected to the ground conductor, wherein the first artificial magnetic conductor and the second artificial magnetic conductor are the only artificial magnetic conductors included in the antenna device, wherein the first artificial magnetic conductor and the second artificial magnetic conductor are multistaged, and wherein the feeding antenna conductor and the non-feeding antenna conductor are disposed on the first artificial magnetic conductor.

2. The antenna device according to claim 1, further comprising a first via conductor that electrically connects the second artificial magnetic conductor to the ground conductor, wherein the first via conductor is provided at a position away from an end of the first artificial magnetic conductor by a predetermined length.

3. The antenna device according to claim 1, wherein the first artificial magnetic conductor has a slit substantially facing a position between the feeding antenna conductor and the non-feeding antenna conductor.

4. The antenna device according to claim 1, further comprising:

a board on which the feeding antenna conductor and the non-feeding antenna conductor are disposed; and a parasitic conductor provided on the board.

5. The antenna device according to claim 4, wherein the parasitic conductor is electrically insulated from the ground conductor and the first artificial magnetic conductor.

6. A communication device comprising:

the antenna device according to claim 1;

a display;

a front panel that protects the display; and a metal frame that surrounds the antenna device and has a window opening larger in area than the antenna device, wherein the antenna device is fixed to the front panel and surrounded by the window opening of the metal frame.

7. The communication device according to claim 6, wherein the metal frame is fixed to the front panel.

8. The communication device according to claim 6, wherein the antenna device is fixed to the front panel with a double-sided tape.

9. An antenna device comprising:

a feeding antenna conductor;

a non-feeding antenna conductor;

a ground conductor;

a first artificial magnetic conductor disposed between (i) the feeding antenna conductor and the non-feeding antenna conductor, and (ii) the ground conductor;

a second artificial magnetic conductor disposed side by side with the first artificial magnetic conductor and electrically connected to the ground conductor; and a third artificial magnetic conductor that is disposed side by side with the first artificial magnetic conductor and is electrically connected to the ground conductor, wherein the first artificial magnetic conductor is disposed between the second artificial magnetic conductor and the third artificial magnetic conductor, wherein the first artificial magnetic conductor, the second artificial magnetic conductor, and the third artificial magnetic conductor are the only artificial magnetic conductors included in the antenna device, wherein the first artificial magnetic conductor, the second artificial magnetic conductor, and the third artificial magnetic conductor are multistaged, and wherein the feeding antenna conductor and the non-feeding antenna conductor are disposed on the first artificial magnetic conductor.

10. The antenna device according to claim 9, further comprising:

a first via conductor that electrically connects the second artificial magnetic conductor to the ground conductor; and a second via conductor that electrically connects the third artificial magnetic conductor to the ground conductor.

11. The antenna device according to claim 10, further comprising a dielectric board on which the first to third artificial magnetic conductors are disposed, wherein the first via conductor and the second via conductor pass through the dielectric board.

12. The antenna device according to claim 11, further comprising a third via conductor that is electrically connected to the feeding antenna conductor and passes through the dielectric board, wherein the third via conductor is electrically insulated from the ground conductor and the first artificial magnetic conductor.

13. The antenna device according to claim 12, further comprising a fourth via conductor that is electrically connected to the non-feeding antenna conductor and passes through the dielectric board, wherein the fourth via conductor is electrically connected to the ground conductor and the first artificial magnetic conductor.

* * * * *